United States Patent [19]

Kamegai et al.

[11] Patent Number: 4,968,450

[45] Date of Patent: Nov. 6, 1990

[54] MILD COSMETIC CLEANSING FOAMS CONTAINING AN HLB3-8 NONIONIC SURFACTANT

[75] Inventors: Jun Kamegai, Chiba; Yasushi Kajihara, Saitama; Masatoshi Arisawa, Chiba, all of Japan

[73] Assignee: Kao Corporation, Tokyo, Japan

[21] Appl. No.: 290,355

[22] Filed: Dec. 23, 1988

[30] Foreign Application Priority Data

Jan. 14, 1988 [JP] Japan ..... 63-6088
May 11, 1988 [JP] Japan ..... 63-114142

[51] Int. Cl.[5] ..... C11D 1/83; C11D 1/831

[52] U.S. Cl. ..... 252/545; 252/174.16; 252/546; 252/557; 252/DIG. 1; 252/DIG. 5; 252/DIG. 17

[58] Field of Search ..... 252/DIG. 5, 174.16, 252/545, 546, 557, DIG. 17

[56] References Cited

U.S. PATENT DOCUMENTS

| | | | |
|---|---|---|---|
| 4,540,507 | 9/1985 | Grollier | 252/174.23 |
| 4,551,330 | 10/1985 | Wagman et al. | 424/59 |
| 4,556,510 | 12/1985 | Holsopple | 252/547 |
| 4,673,525 | 6/1987 | Small et al. | 252/132 |
| 4,707,292 | 11/1987 | Sano et al. | 252/174.16 |
| 4,749,515 | 6/1988 | Miyamoto et al. | 252/545 |

*Primary Examiner*—Paul Lieberman
*Assistant Examiner*—A. Beadles-Hay
*Attorney, Agent, or Firm*—Flynn, Thiel, Boutell & Tanis

[57] ABSTRACT

A detergent composition comprises (A) a nonionic surfactant represented by the general formula (I):

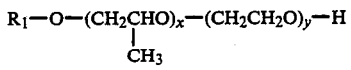

(I)

and having an HLB value of 3 or above but below 8, and (B) a phosphate surfactant represented by the general formula (II) or (III):

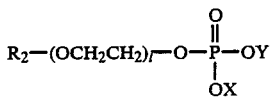

(II)

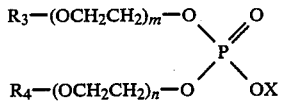

(III)

or at least one lowly irritant anionic surfactant selected from among (i) N-acylglutamate surfactants, (ii) isethionate surfactants, and (iii) sulfosuccinate surfactants.

17 Claims, No Drawings

MILD COSMETIC CLEANSING FOAMS CONTAINING AN HLB3-8 NONIONIC SURFACTANT

The present invention relates to a novel detergent composition. Particularly, it relates to a body detergent composition which exhibits high detergency against smear due to makeup cosmetics such as lipstick or foundation or dirt due to sebum and low irritation to the skin or the hair.

PRIOR ART

Smear due to makeup cosmetics such as lipstick, foundation, eye shadow or mascara contains a lot of oil or solid fat, so that it cannot be removed with a conventional face cleansing foam mainly comprising a soap, because such a foam is insufficient in solubilizing and emulsifying powers. Therefore, smear due to makeup cosmetics has been removed with a cleansing cream, oil or gel mainly comprising an oily base material.

Meanwhile, dirt such as fat or keratinous protein enters into the follicular orifice and solidifies therein to cause inflammation such as acne. Such solid dirt clogging the follicular orifice cannot be sufficiently removed with a conventional face cleansing preparation owing to its poor detergency, so that the simultaneous use of such a detergent with a keratolytic such as salicylic acid or sulfur has been general practice.

As described above, smear due to makeup cosmetics or a solid fat such as sebum or hard oily dirt cannot be removed with a conventional face cleansing preparation mainly comprising a fatty acid soap or an anionic or nonionic surfactant, because such a detergent is poor in detergency. Meanwhile, for example, a cleansing cream mainly comprising an oily base material has another disadvantage in that the emulsion state of the cream is deteriorated by moisturization to result in lowered detergency and phase separation, when it is used in a high-temperature and high-humidity atmosphere such as bath.

SUMMARY OF THE INVENTION

The inventors of the present invention have eagerly studied to solve the above problems and have found that a foaming detergent composition which exhibits high detergency against makeup smear and oily or fatty dirt and has low irritation to the skin and excellent stability even in a high-humidity atmosphere can be obtained by combining a specified nonionic surfactant with a phosphate surfactant or at least one low irritant anionic surfactant selected from N-acylglutamate surfactants, isethionate surfactants and sulfosuccinate surfactants.

Namely, the present invention provides a detergent composition comprising (A) a nonionic surfactant represented by the general formula (I):

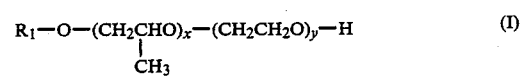

$$R_1-O-(CH_2\underset{\underset{CH_3}{|}}{C}HO)_x-(CH_2CH_2O)_y-H \quad (I)$$

wherein $R_1$ stands for a branched, saturated or unsaturated, hydrocarbon group having 4 to 30 carbon atoms; x stands for an integer of 0 to 30 and y stands for an integer of 0 to 30 with the proviso that $x+y \geqq 1$, and having an HLB value of 3 or above but below 8, and (B) a phosphate surfactant represented by the general formula (II) or (III):

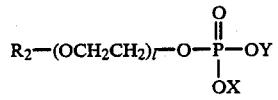

$$R_2-(OCH_2CH_2)_l-O-\overset{\overset{O}{\|}}{\underset{\underset{OX}{|}}{P}}-OY \quad (II)$$

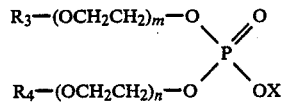

$$\begin{matrix} R_3-(OCH_2CH_2)_m-O & & O \\ & P & \\ R_4-(OCH_2CH_2)_n-O & & OX \end{matrix} \quad (III)$$

wherein $R_2$, $R_3$ and $R_4$ each stand for a straight-chain or branched alkyl or alkenyl group having 8 to 18 carbon atoms; X and Y each stand for a hydrogen atom, an alkali metal, ammonium or an alkanolamine group having a hydroxyalkyl group having 2 to 3 carbon atoms and l, m and n are each 0 to 10 or at least one lowly irritant anionic surfactant selected from among (i) N-acylglutamate surfactants, (ii) isethionate surfactants, and (iii) sulfosuccinate surfactants.

In the invention, the component (B) is one of surfactants (II), (III), (i), (ii) and (iii) or a mixture thereof with each other.

The nonionic surfactant represented by the general formula (I) to be used as the component (A) in the present invention must have both an HLB value of 3 or above but below 8 and a branched chain.

In this specification, all HLB values are calculated according to the following equation of Oda and Teramura from organicity and inorganicity:

$$HLB = \frac{\Sigma \text{ inorganicity value}}{\Sigma \text{ organicity value}} \times 10$$

If the HLB of the nonionic surfactant is below 3, the hydrophobic nature will be so strong that the surfactant will increase in oiliness to exhibit a remarkably lowered ability to foam, while if the HLB thereof is 8 or above, the hydrophilic nature will be so strong that the detergency and emulsifying power against the smear due to makeup cosmetics will be poor. Thus, the HLB of the nonionic surfactant must be 3 or above but below 8, while it is particularly preferably 6 to 7.5.

Further, a nonionic surfactant having a straight-chain hydrocarbon group is too poor in detergency to attain the object of removing oily or fatty dirt according to the present invention, even if it has an HLB value falling in the above range. That is, only a nonionic surfactant having a branched hydrocarbon group and an HLB value falling in the range defined above can exhibit detergency enough to remove makeup smear or hard fatty dirt due to sebum.

In the compound represented by the general formula (I) to be used as the component (A) in the present invention, preferred examples of the branched hydrocarbon group include secondary branched alkyl groups each having 4 to 30 carbon atoms or those selected from among 2-ethylhexyl, 2-ethyloctyl, 2-ethyldecyl, 2-ethyldodecyl, 2-butyloctyl, 2-butyldecyl, 2-butyldodecyl, 2-butyltetradecyl, 2-hexyldecyl, 2-hexyldodecyl, 2-hexyltetradecyl, 2-hexylhexadecyl, 2-octyldecyl, 2-octyldodecyl, 2-octyltetradecyl, 2-octylhexadecyl, 2-octyloctyldecyl, 2-decyltetradecyl, 2-heptylundecyl and methyl-branched isostearyl groups. Among them, branched secondary alkyl groups each having 10 to 14 carbon atoms and 2-hexyldecyl, 2-ethylhexyl, 2-octyldodecyl and 2-heptylundecyl groups are still preferred.

Further, in the nonionic surfactant represented by the general formula (I), the numbers of the propylene oxide and ethylene oxide units added, x and y, may be each selected in the range of 0 to 30. It is preferred that x be 0 to 30 and y be 1 to 20. Particularly, it is still preferred that x be 0 to 4 and y be 3 to 10.

It is preferred that the phosphate surfactant represented by the general formula (II) or (III) to be used as the component (B) in the present invention contain 0 to 3 ethylene oxide units added. Particularly, it is still preferred that it contain no ethylene oxide unit added and have an alkyl group having 12 to 14 carbon atoms.

Preferred examples of the component (B) include sodium mono- or di-lauryl phosphate, potassium mono- or di-lauryl phosphate, diethanolamine mono- or di-lauryl phosphate, triethanolamine mono- or dilauryl phosphate, sodium mono- or di-myristyl phosphate, potassium mono- or di-myristyl phosphate, diethanolamine mono- or di-myristyl phosphate and triethanolamine mono- or di-myristyl phosphate.

Further, it is preferred to simultaneously use a compound represented by the general formula (II) and a compound represented by the general formula (III) in a weight ratio of between 10:0 and 5:5, particularly between 10:0 and 7:3, as the component (B).

Among the surfactants to be used as the component (B) in the present invention, the N-acylglutamate surfactant includes compounds represented by the general formula:

$$R_2-CONHCH(CH_2CH_2COOM_2)-COOM_1 \quad \text{(IV)}$$

wherein $R_2$ stands for an alkyl or alkenyl group having 7 to 21 carbon atoms and $M_1$ and $M_2$ each stand for H, an alkali metal or a cationic group derived from an alkanolamine.

Although the compounds represented by the general formula (V) include L-form, D-form and racemic mixtures, any of them may be used in the present invention. Preferred examples thereof include N-lauroylglutamic acid, N-myristoylglutamic acid, N-palmitoylglutamic acid, N-stearoylglutamic acid, N-cocoylglutamic acid and salts thereof with sodium, potassium, triethanolamine, monoethanolamine and diethanolamine.

Among the surfactants to be used as the component in the present invention, the isethionate surfactant includes compounds represented by the general formula:

$$R_3-COOCH_2CH_2SO_3M \quad \text{(V)}$$

wherein $R_3$ stands for an alkyl or alkenyl group having 7 to 21 carbon atoms and M stands for H, an alkali metal or a cationic group derived from an alkanolamine.

In the compound represented by the general formula (V), the fatty acid residue $R_3$—COO— includes those derived from lauric, myristic, oleic and coconut oil fatty acids, while examples of the counter cation represented by M include potassium, sodium, triethanolamine, diethanolamine and monoethanolamine.

Among the surfactants to be used as the component (B) in the present invention, the sulfosuccinate surfactant includes sulfosuccinates of higher alcohols or their ethoxylates and sulfosuccinates derived from higher fatty acid amides, represented by the general formua (VI) or (VII):

$$R_4-C(=O)-CH(SO_3M')-CH_2-COOM' \quad \text{(VI)}$$

$$R_4-C(=O)-CH_2-CH(SO_3M')-COOM' \quad \text{(VII)}$$

wherein $R_4$ stands for $R_5O-(CH_2CH_2O)_m-$ or $R_6CONH-(CH_2CH_2O)_m-$ (wherein $R_5$ stands for a straight-chain or branched alkyl or alkenyl group having 8 to 22 carbon atoms; R stands for a straight-chain or branched alkyl or alkenyl group having 7 to 21 carbon atoms and m is 0 to 20) and M' stands for H or a water-soluble salt forming cation selected from among alkali metals, alkaline earth metals, ammonium and organic ammoniums.

Among the compounds represented by the general formula (VI) or (VII), the sulfosuccinate of a higher alcohol or its ethoxylate includes disodium salts of sulfosuccinates of ethoxylates of secondary alcohols having 11 to 13 carbon atoms (for example, softanol MES-3, 5, 7, 9, 12; products of Nippon Shokubai Kagaku Kogyo Co., Ltd., each figure stands for the average number of ethylene oxide units added), disodium salts of sulfosuccinates of lauryl alcohol or lauryl alcohol ethoxylate (EO: 3, 6, 9, 12), disodium salts of sulfosuccinates of synthetic primary alcohols having 12 to 15 carbon atoms or their ethoxylate (EO: 2 to 4). Further, the sulfosuccinate derived from higher fatty acid amide includes disodium salts of sulfosuccinates of lauric polyethylene glycol (EO: 1, 2) amide, disodium salts of sulfosuccinates of oleic polyethylene glycol (EO: 1, 2) amide and sodium salts of sulfosuccinates of polyethylene glcyol (EO: 4) amide of coconut oil fatty acid.

According to the present invention, the total content of the components (A) and (B) in the detergent composition is preferably 10 to 90% by weight, still preferably 20 to 60% by weight. Further, although the weight ratio of (A) to (B) may be arbitrarily selected in the range between 1:9 and 9:1, it is preferably between 1:9 and 4:6.

In addition to the above lowly irritant anionic surfactant, the detergent composition of the present invention may further contain a conventional detergent such as fatty acid soap, alkyl sulfate or alkylethoxy sulfate, as long as the low irritativeness and high detergency of the present invention is not adversely affected. Further, for the purpose of enhancing the ability to foam, the detergent composition of the present invention may further contain an anionic, amphoteric or nonionic surfactant in addition to the above essential components, as long as the effect of the present invention is not affected adversely. Furthermore, it may further contain a thickener such as an anionic or nonionic polymer or other conventional additives such as stabilizer, perfume, dyestuff or the like As described above, according to the present invention, a cleansing foam for the face or body which exhibits detergency high enough to remove makeup smear can be provided by combining a specified branched nonionic surfactant with at least one lowly irritant component selected from a phosphate surfactant, N-acylglutamate surfactants, isethionate surfactants, sulfosuccinate surfactants and their mixtures. The invention detergent imparts moistness to the skin and is of low irritation to the skin in spite of its high detergency. Further, the detergent composition can be used even in a high-humidity bath, though it has been problematic to use a conventional cleansing cream under such a condition. Furthermore, it can remove the dirt clogging follicular orifice of the skin which causes acne.

EXAMPLES

The present invention will be described in more detail by referring to the following Examples, though it is not limited to them.

EXAMPLE 1

Detergent compositions of the formulations given in Table 1 were prepared and examined for performance according to the following methods. The results are also shown in Table 1.

(1) Detergency test

A. Artificially stained cloth method (a) Preparation of artificially stained cloth Artificial oily and fatty dirt were homogeneously dispersed in a solvent. A cotton cloth was brought into contact with the obtained dispersion and dried to make the dirt adhere uniformly to the cloth. The resulting cloth was cut into test pieces (10 cm×10 cm) and used in the following test.

(b) Conditions and method of cleansing A detergent composition was dissolved in hard water having a hardness of 4° DH to obtain 500 ml of a 3% (by weight) aqueous solution of the composition. The above test pieces were washed with this solution in sets of five in a Terg-O-Tometer under stirring at the rate of 100 rpm at 30° C. for 5 minutes, rinsed with flowing water and pressed with an iron. The resulting cloths were examined for reflectance to determine the rate of cleansing. The evaluation was carried out according to the criteria which will be described.

B. Pigskin method

A lipstick was uniformly applied to a pigskin (2 cm×2 cm) within a circular area having a diameter of 1 cm. After 30 minutes, 5 droplets of a 20% (by weight) aqueous solution of the composition were let to fall in the circle. The resulting pigskin was massaged with a flat glass rod for 20 seconds, rinsed with flowing water and dried. The lipstick remaining in the pigskin was extracted with hexane, followed by the UV spectrophotometry. Thus, the rate of cleansing was determined and evaluated according to the following criteria:

Evaluation criteria

◎: 80% or above

○: 70% or above but below 80%

Δ: 60% or above but below 70% x: below 60%

(2) Sensory evaluation

Each of the detergent compositions was suitably diluted with tap water to prepare a foam. Seven expert panelists each washed the hands and face with this foam to evaluate the composition sensuously.

A. Foaming

Evaluation criteria

◎: excellent foaming

○: medial foaming

Δ: slightly poor foaming x: poor foaming

B. Moistness and tenseness of the skin after the washing

Evaluation criteria

◎: moist without tenseness

○: medial

Δ: less moist with tenseness x: no moist with tenseness

TABLE 1

| | | Comparative product | | | | | | | | | | | | Product of this invention | | | | | | | | |
|---|---|---|---|---|---|---|---|---|---|---|---|---|---|---|---|---|---|---|---|---|---|---|
| | | 1 | 2 | 3 | 4 | 5 | 6 | 7 | 8 | 9 | 10 | 11 | 12 | 1 | 2 | 3 | 4 | 5 | 6 | 7 | 8 | 9 |
| Detergent composition (% by weight) | monotriethanolamine N-lauroylglutaminate | 30 | | | 20 | 20 | 20 | | | | | | | 20 | 20 | 20 | | | | | | |
| | sodium cocoylisethionate | | 30 | | | | | 20 | 20 | 20 | | | | | | | 20 | 20 | 20 | | | |
| | lauryl disodium sulfosuccinate | | | 30 | | | | | | | 20 | 20 | 20 | | | | | | | 20 | 20 | 20 |
| | polyoxyethylene (EO 3.0) sec-tetradecyl ether HLB 7.1 | | | | | | | | | | | | | 10 | | | 10 | | | 10 | | |
| | polyoxypropylene (PO 2) polyoxyethylene (EO 2) 2-ethylhexyl ether HLB 6.5 | | | | | | | | | | | | | | 10 | | | 10 | | | 10 | |
| | polyoxyethylene (EO 4.0) 2-hexyldecyl ether HLB 6.7 | | | | | | | | | | | | | | | 10 | | | 10 | | | 10 |
| | polyoxyethylene (EO 15) 2-hexyldecyl ether HLB 12.9 | | | | 10 | | | 10 | | | 10 | | | | | | | | | | | |
| | polyoxyethylene (EO 5.0) oleyl ether HLB 7.5 | | | | | 10 | | | 10 | | | 10 | | | | | | | | | | |
| | polyoxyethylene (EO 20) oleyl ether HLB 14 | | | | | | 10 | | | 10 | | | 10 | | | | | | | | | |
| | triethanolamine laurate | | | | 5 | 5 | 5 | 5 | 5 | 5 | 5 | 5 | 5 | 5 | 5 | 5 | 5 | 5 | 5 | 5 | 5 | 5 |
| | ion-exchanged water | 70 | 70 | 70 | 65 | 65 | 65 | 65 | 65 | 65 | 65 | 65 | 65 | 65 | 65 | 65 | 65 | 65 | 65 | 65 | 65 | 65 |
| Detergency test | sebum dirt (artificially stained cloth method) | x | x | x | Δ | x | x | Δ | x | x | Δ | x | x | ◎ | ◎ | ◎ | ◎ | ◎ | ◎ | ◎ | ◎ | ◎ |
| | makeup smear (pigskin method) | x | x | x | x | Δ | x | x | Δ | x | x | Δ | x | ◎ | ◎ | ◎ | ◎ | ◎ | ◎ | ◎ | ◎ | ◎ |
| Organoleptic evaluation | foaming | Δ | ○ | ○ | Δ | x | Δ | ○ | x | ○ | ○ | x | ○ | ○ | ○ | ○ | ○ | ◎ | ○ | ○ | ◎ | ○ |
| | moistness | Δ | Δ | Δ | Δ | Δ | Δ | Δ | Δ | Δ | Δ | Δ | Δ | ○ | ○ | ○ | ○ | ○ | ○ | ○ | ○ | ○ |
| | tenseness | ○ | Δ | ○ | ○ | ○ | Δ | ○ | Δ | ○ | ○ | ○ | ○ | ○ | ○ | ○ | ○ | ○ | ○ | ○ | ○ | ○ |

EXAMPLE 2

| | |
|---|---|
| (1) monoethanolamine N-lauroylglutamate | 35 (% by weight) |

-continued

| | |
|---|---|
| (2) polyoxypropylene (PO 2) polyoxyethylene (EO 2) 2-ethylhexyl ether | 15 |
| (3) ethylene glycol distearate (Emanon 3201M) | 3 |
| (4) polytriethanolammonium acrylate (Carbopol 941) | 0.5 |
| (5) ethanol | 5 |
| (6) perfume | a slight amount |
| (7) ion-exchanged water | the balance |

EXAMPLE 3

| | |
|---|---|
| (1) monotriethanolamine N-lauroylglutamate | 10 (% by weight) |
| (2) polyoxyethylene (EO 3.0) sec-tetradecyl ether | 20 |
| (3) triethanolamine myristate | 10 |
| (4) glycerin | 8 |
| (5) ethylene glycol distearate (Emanon 3201M) | 3 |
| (6) butylhydroxytoluene | 0.2 (% by weight) |
| (7) ethanol | 3 |
| (8) perfume | a slight amount |
| (9) ion-exchanged water | the balance |

The components (1) to (6) were dissolved in heated water, followed by cooling. The components (7) and (8) were added to the resulting solution to obtain a face cleansing preparation.

This preparation was effective in removing makeup smear and in cleansing the face to give a feeling of moistness.

EXAMPLE 4

| | |
|---|---|
| (1) sodium cocoylisethionate | 20 (% by weight) |
| (2) polyoxypropylene (PO 5) polyoxyethylene (EO 5) 2-hexyldecyl ether | 10 |
| (3) myristic acid | 1 |
| (4) ethylene glycol distearate (Emanon 3201M) | 3 |
| (5) ethanol | 2 |
| (6) perfume | a slight amount |
| (7) ion-exchanged water | the balance |

The components (1) to (4) were dissolved in heated water, followed by cooling. The components (5) and (6) were added to the resulting solution to obtain a face cleansing preparation.

This preparation was effective in removing makeup smear and in cleaning the face to give a feeling of moistness.

EXAMPLE 5

| | |
|---|---|
| (1) lauryl disodium sulfosuccinate | 20 (% by weight) |
| (2) polyoxyethylene (EO 4.0) 2-hexyldecyl ether | 10 |
| (3) myristic acid | 1 |
| (4) lauric acid | 4 |
| (5) ethylene glycol distearate | 3 |
| (6) ethanol | 4 |
| (7) α-tocophenrol | 0.2 |
| (8) perfume | a slight amount |
| (9) dyestuff | a slight amount |
| (10) ion-exchanged water | the balance |

The components (1) to (5), (7) and (9) were dissolved in heated water, followed by cooling. The components (6) and (8) were added to the resulting solution to obtain a face cleansing preparation.

This preparation was effective in removing makeup smear and in cleansing the face to give a feeling of moistness.

EXAMPLE 6

| | |
|---|---|
| (1) sodium N-lauroylglutamate | 10 (% by weight) |
| (2) sodium cocolyisethionate | 10 |
| (3) lauryl disodium sulfosuccinate | 10 (% by weight) |
| (4) polyoxyethylene (EO 3.0) sec-tetradecyl ether | 8 |
| (5) myristic acid | 5 |
| (6) polyoxyethylene (EO 120) distearate | 0.5 |
| (7) salt | 8 |
| (8) polyethylene glycol 200 | 1 |
| (9) perfume | a slight amount |
| (10) ion-exchanged water | the balance |

The components (1) to (8) were dissolved in heated water, followed by the addition of the component (9). Thus, a pasty face cleansing preparation was obtained.

This preparation was effective in removing makeup smear and in cleansing the face to give a feeling of moistness.

EXAMPLE 7

Detergent compositions of the formulations given in Table 2 were prepared and examined for performance according to the example 1. Results are also shown in Table 2.

TABLE 2

| | | Comp. 1A | Comp. 2A | Comp. 3A | Comp. 4A | Comp. 5A | Comp. 6A |
|---|---|---|---|---|---|---|---|
| Detergent composition (% by weight) | triethanolamine monolauryl phosphate | 30.0 | 30.0 | 20.0 | 20.0 | 20.0 | 20.0 |
| | polyoxyethylene (EO 3.0) sec-tetradecyl ether HLB 7.1 | | | | | | |
| | polyoxyethylene (EO 3.3) sec-tetradecyl ether HLB 7.5 | | | | | | |
| | polyoxypropylene (PO 2) polyoxyethylene (EO 2) 2-ethylhexyl ether HLB 6.5 | | | | | | |
| | polyoxyethylene (EO 4.0) 2-hexyldecyl ether HLB 6.7 | | | | | | |
| | polyoxyethylene (EO 5.0) sec-tetradecyl ether HLB 9.1 | | | 10.0 | | | |
| | polyoxyethylene (EO 15) 2-hexyldecyl ether HLB 12.9 | | | | | | 10.0 |
| | polyoxyethylene (EO 5.0) oleyl ether HLB 7.5 | | | | 10.0 | | |

TABLE 2-continued

| | | | | | | | | |
|---|---|---|---|---|---|---|---|---|
| | polyoxyethylene (EO 20.0) oleyl ether HLB 14 | | | | | | 10.0 | |
| | polyoxyethylene (EO 80.0) hardened castor oil HLB 16 | | | | | | | |
| | triethanolamine laurate | | 5.0 | 5.0 | 5.0 | 5.0 | 5.0 |
| | ion-exchanged water | 70.0 | 65.0 | 65.0 | 65.0 | 65.0 | 65.0 |
| Rate of cleansing (%) | sebum dirt (artificially stained cloth method) | x | x | Δ | x | x | Δ |
| | makeup smear (pigskin method) | x | x | Δ | x | x | x |
| Organoleptic evaluation | foaming | Δ | ○ | Δ | x | ○ | ○ |
| | moistness | Δ | Δ | ○ | ○ | ○ | Δ |
| | tenseness | ○ | ○ | ○ | ○ | ○ | ○ |

| | | Invention 1A | Invention 2A | Invention 3A | Invention 4A | Invention 5A | Invention 6A | Invention 7A |
|---|---|---|---|---|---|---|---|---|
| Detergent composition (% by weight) | triethanolamine monolauryl phosphate | 20.0 | 20.0 | 20.0 | 20.0 | 20.0 | 21.0 | 24.0 |
| | polyoxyethylene (EO 3.0) sec-tetradecyl ether HLB 7.1 | 10.0 | | | | | 9.0 | 6.0 |
| | polyoxyethylene (EO 3.3) sec-tetradecyl ether HLB 7.5 | | 10.0 | | | | | |
| | polyoxypropylene (PO 2) polyoxyethylene (EO 2) 2-ethylhexyl ether HLB 6.5 | | | 10.0 | | | | |
| | polyoxyethylene (EO 4.0) 2-hexyldecyl ether HLB 6.7 | | | | 10.0 | 10.0 | | |
| | polyoxyethylene (EO 5.0) sec-tetradecyl ether HLB 9.1 | | | | | | | |
| | polyoxyethylene (EO 15) 2-hexyldecyl ether HLB 12.9 | | | | | | | |
| | polyoxyethylene (EO 5.0) oleyl ether HLB 7.5 | | | | | | | |
| | polyoxyethylene (EO 20.0) oleyl ether HLB 14 | | | | | | | |
| | polyoxyethylene (EO 80.0) hardened castor oil HLB 16 | | | | | 5.0 | | |
| | triethanolamine laurate | 5.0 | 5.0 | 5.0 | 5.0 | 5.0 | 5.0 | 5.0 |
| | ion-exchanged water | 65.0 | 65.0 | 65.0 | 65.0 | 60.0 | 65.0 | 65.0 |
| Rate of cleansing (%) | sebum dirt (artificially stained cloth method) | ⊙ | ⊙ | ⊙ | ⊙ | ⊙ | ⊙ | ○ |
| | makeup smear (pigskin method) | ⊙ | ⊙ | ⊙ | ⊙ | ⊙ | ⊙ | ⊙ |
| Organoleptic evaluation | foaming | ○ | ○ | ○ | ○ | ○ | ○ | Δ |
| | moistness | ⊙ | ⊙ | ⊙ | ⊙ | ⊙ | ⊙ | ⊙ |
| | tenseness | ⊙ | ⊙ | ⊙ | ⊙ | ⊙ | ⊙ | ⊙ |

EXAMPLE 8

| | |
|---|---|
| (1) ditriethanolamine lauryl phosphate | 30 (% by weight) |
| (2) polyoxyethylene (EO 3.0) sec-tetradecyl ether | 12 |
| (3) ethylene glycol distearate (Emanon 3201M) | 3 |
| (4) ethanol | 2 |
| (5) perfume | a slight amount |
| (6) ion-exchanged water | the balance |

The components (1) to (3) were dissolved in heated water. The obtained solution was cooled, followed by the addition of the components (4) and (5). Thus, a face cleansing preparation was prepared.

This preparation was effective both in removing the smear due to makeup cosmetics and in cleansing the face to give a feeling of moistness.

EXAMPLE 9

| | |
|---|---|
| (1) diethanolamine lauryl phosphate | 35 (% by weight) |
| (2) polyoxyethylene (PO 2) polyoxyethylene (EO 2) 2-ethylhexyl ether | 15 |

-continued

| | |
|---|---|
| (3) ethylene glycol distearate (Emanon 3201M) | 3 |
| (4) polytriethanolammonium acrylate (Carbopol 941) | 0.5 |
| (5) ethanol | 5 |
| (6) perfume | a slight amount |
| (7) ion-exchanged water | the balance |

The components (1) to (4) were dissolved in heated water. The obtained solution was cooled, followed by the addition of the components (5) and (6). Thus, a face cleansing preparation was prepared.

This preparation was effective both in removing smear due to makeup cosmetics and in cleansing the face to give a feeling of moistness.

EXAMPLE 10

| | |
|---|---|
| (1) diethanolamine lauryl phosphate | 10 (% by weight) |
| (2) polyoxyethylene (EO 3.3) sec-tetradecyl ether | 20 |
| (3) triethanolamine myristate | 10 |
| (4) glycerin | 8 |
| (5) ethylene glycol distearate (Emanon 3201M) | 3 |
| (6) butylhydroxytoluene | 0.2 |
| (7) ethanol | 3 |

-continued

| | |
|---|---|
| (8) perfume | a slight amount |
| (9) ion-exchanged water | the balance |

The components (1) to (6) were dissolved in heated water. The obtained solution was cooled, followed by the addition of the components (7) and (8). Thus, a face cleansing preparation was prepared as in the preceding Examples.

This preparation was effective both in removing the smear due to makeup cosmetics and in cleansing the face to give a feeling of moistness.

We claim:

1. A detergent composition comprising (A) a nonionic surfactant represented by the general formula (I):

$$R_1-O-(CH_2\underset{\underset{CH_3}{|}}{C}HO)_x-(CH_2CH_2O)_y-H \quad (I)$$

wherein $R_1$ stands for a branched, saturated or unsaturated, hydrocarbon group having 4 to 30 carbon atoms; x stands for an integer of 0 to 30 and y stands for an integer of 0 to 30 with the proviso that $x+y \geqq 1$, and having an HLB value of 3 or above but below 8, and (B) a phosphate surfactant represented by the general formula (II) or (III):

$$R_2-(OCH_2CH_2)_l-O-\overset{\overset{O}{\|}}{\underset{\underset{OX}{|}}{P}}-OY \quad (II)$$

$$\begin{matrix} R_3-(OCH_2CH_2)_m-O \\ R_4-(OCH_2CH_2)_n-O \end{matrix} \diagup P \begin{matrix} \diagdown O \\ \diagdown OX \end{matrix} \quad (III)$$

wherein $R_2$, $R_3$ and $R_4$ each stand for a straight-chain or branched alkyl or alkenyl group having 8 to 18 carbon atoms; X and Y each stand for a hydrogen atom, an alkali metal, ammonium or an alkanolamine group having a hydroxy-alkyl group having 2 to 3 carbon atoms and 1, m and n are each 0 to 10 or at least one anionic surfactant selected from among (i) N-acylglutamate surfactants, (ii) isethionate surfactants, and (iii) sulfosuccinate surfactants, wherein the total content of the components (A) and (B) in the detergent composition is 10 to 90% by weight and the weight ratio of (A) to (B) is between 1:9 and 9:1.

2. A detergent composition as set forth in claim 1, wherein component (B) is a N-acylglutamate surfactant.

3. A detergent composition as set forth in claim 2, wherein said N-acylglutamate surfactant is a compound selected from among those represented by the general formula (II):

$$R_2-CONH\underset{\underset{CH_2CH_2COOM_2}{|}}{C}H-COOM_1 \quad [II]$$

wherein $R_2$ stands for an alkyl or alkenyl group having 7 to 21 carbon atoms and $M_1$ and $M_2$ each stand for H, an alkali metal or a cationic group derived from an alkanolamine.

4. A detergent composition as set forth in claim 2, wherein component (B) is monotriethanol N-lauroylglutaminate.

5. A detergent composition as set forth in claim 1, wherein component (B) is an isethionate surfactant.

6. A detergent composition as set forth in claim 4, wherein said isethionate surfactant is a compound selected from among those represented by the general formula (III):

$$R_3-COOCH_2CH_2SO_3M \quad (III)$$

wherein $R_3$ stands for an alkyl or alkenyl group having 7 to 21 carbon atoms and M stands for H, an alkali metal or a cationic group derived from an alkanolamine.

7. A detergent composition as set forth in claim 5, wherein component (B) is sodium cocoylisethionate.

8. A detergent composition as set forth in claim 1, wherein component (B) is a sulfosuccinate surfactant.

9. A detergent composition as set forth in claim 8, wherein said sulfosuccinate surfactant is a compound selected from among those represented by the general formula (IV) or (V):

$$R_4-\overset{\overset{O}{\|}}{C}-\underset{\underset{SO_3M'}{|}}{C}H-CH_2-COOM' \quad [IV]$$

$$R_4-\overset{\overset{O}{\|}}{C}-CH_2-\underset{\underset{SO_3M'}{|}}{C}H-COOM' \quad [V]$$

wherein $R_4$ stands for $R_5O-(CH_2CH_2O)_m-$ or $R_6CONH-(CH_2CH_2O)_m-$ (wherein $R_5$ stands for a straight-chain or branched alkyl or alkenyl group having 8 to 22 carbon atoms; $R_6$ stands for a straight-chain or branched alkyl or alkenyl group having 7 to 21 carbon atoms and m is 0 to 20) and M' stands for H or a water-soluble salt forming cation selected from among alkali metals, alkaline earth metals, ammonium and organic ammoniums.

10. A detergent composition as set forth in claim 8, wherein component (B) is lauryl disodium sulfosuccinate.

11. A detergent composition as set forth in claim 1, wherein said nonionic surfactant has an HLB of from 6 to 7.5.

12. A detergent composition as set forth in claim 1, wherein x is an integer of 0 to 4 and y is an integer of from 3 to 10.

13. A detergent composition as set forth in claim 1, wherein component (B) is triethanol amine monolauryl phosphate.

14. A detergent composition as set forth in claim 1, wherein said nonionic surfactant is polyoxypropylene (PO 2) polyoxyethylene (EO 2) 2-ethylhexyl ether.

15. A detergent composition as set forth in claim 1, wherein said nonionic surfactant is a member selected from the group consisting of polyoxyethylene (EO 3) sec-tetradecyl ether, polyoxyethylene (EO 3.3) tetradecyl ether, polyoxypropylene (PO 2) polyoxyethylene (EO 2) 2-ethylhexyl ether and polyoxyethylene (EO 4)

2-hexyldecyl ether and said component (B) is triethanolamine monolauryl phosphate.

16. A detergent composition as set forth in claim 1, wherein said nonionic surfactant is polyoxypropylene (PO 2) polyoxyethylene (EO 2) 2-ethylhexyl ether and said component (B) is sodium cocoylisethionate.

17. A detergent composition as set forth in claim 1, wherein said nonionic surfactant is polyoxypropylene (PO 2) polyoxyethylene (EO 2) 2-ethylhexyl ether and said component (B) is lauryl disodium sulfosuccinate.

* * * * *

UNITED STATES PATENT AND TRADEMARK OFFICE

CERTIFICATE OF CORRECTION

PATENT NO. : 4,968,450

DATED : November 6, 1990

INVENTOR(S) : Jun KAMEGAI

It is certified that error appears in the above-identified patent and that said Letters Patent is hereby corrected as shown below:

Column 12, line 10; change "claim 4" to ---claim 5---.

Signed and Sealed this

Sixth Day of October, 1992

*Attest:*

DOUGLAS B. COMER

*Attesting Officer*

*Acting Commissioner of Patents and Trademarks*